US008071268B2

(12) United States Patent
Shirai et al.

(10) Patent No.: US 8,071,268 B2
(45) Date of Patent: Dec. 6, 2011

(54) ELECTROPHOTOGRAPHIC TONER

(75) Inventors: Eiji Shirai, Wakayama (JP); Satoshi Kunii, Wakayama (JP)

(73) Assignee: Kao Corporation, Tokyo (JP)

( * ) Notice: Subject to any disclaimer, the term of this patent is extended or adjusted under 35 U.S.C. 154(b) by 975 days.

(21) Appl. No.: 11/995,542

(22) PCT Filed: Aug. 3, 2006

(86) PCT No.: PCT/JP2006/315411

§ 371 (c)(1),
(2), (4) Date: Jan. 14, 2008

(87) PCT Pub. No.: WO2007/018125

PCT Pub. Date: Feb. 15, 2007

(65) Prior Publication Data

US 2009/0117482 A1 May 7, 2009

(30) Foreign Application Priority Data

Aug. 5, 2005 (JP) ..... 2005-228705

(51) Int. Cl.
*G03G 9/08* (2006.01)

(52) U.S. Cl. ..... 430/108.2; 430/108.23; 430/108.1

(58) Field of Classification Search ..... 430/108.2, 430/108.23, 108.1
See application file for complete search history.

(56) References Cited

U.S. PATENT DOCUMENTS

| | | | |
|---|---|---|---|
| 4,221,856 | A | 9/1980 | Lu |
| 7,309,558 | B1 | 12/2007 | Michel et al. |
| 2003/0118929 | A1 | 6/2003 | Shirai et al. |
| 2003/0129518 | A1 | 7/2003 | Sawada et al. |

FOREIGN PATENT DOCUMENTS

| | | |
|---|---|---|
| JP | 54-134441 | 10/1979 |
| JP | 62-19483 | 1/1987 |
| JP | 8-6295 | 1/1996 |
| JP | 8-123096 | 5/1996 |
| JP | 2003-107781 | 4/2003 |
| JP | 2003-515795 | 5/2003 |
| JP | 2003-167384 | 6/2003 |
| JP | 2003-202708 | 7/2003 |
| JP | 2004-4207 | 1/2004 |
| JP | 2004-12581 | 1/2004 |
| JP | 2004-20731 | 1/2004 |
| JP | 2004-77577 | 3/2004 |
| JP | 2004-78180 | 3/2004 |
| JP | 2004-117651 | 4/2004 |
| JP | 2004-309718 | 11/2004 |

*Primary Examiner* — Mark Chapman
(74) *Attorney, Agent, or Firm* — Oblon, Spivak, McClelland, Maier & Neustadt, L.L.P.

(57) ABSTRACT

The present invention relates to a toner for electrophotography containing a resin binder, a colorant, and a clay-organic complex obtained by intercalating into a smectite clay a quaternary ammonium salt represented by the formula (A):

$$[(R^1)_3(R^2)N]^+.X^- \quad (A)$$

wherein $R^1$ and $R^2$ are not identical; $R^1$ is an alkyl group, alkenyl group, or alkynyl group, each having 4 to 24 carbon atoms; $R^2$ is an alkyl group, alkenyl group, or alkynyl group, each having 1 to 10 carbon atoms; and $X^-$ is an anion. The toner for electrophotography of the present invention is suitably used for, for example, developing a latent image formed in electrophotography, electrostatic recording method, electrostatic printing method, or the like.

18 Claims, No Drawings

ELECTROPHOTOGRAPHIC TONER

TECHNICAL FIELD

The present invention relates to a toner for electrophotography used for, for example, developing a latent image formed in electrophotography, electrostatic recording method, electrostatic printing method, or the like.

BACKGROUND ART

One of the important factors desired for a toner used for an electrophotographic system includes triboelectric charging property, especially initial rise of triboelectric charges. When initial rise of triboelectric charges is poor, homogeneous image quality cannot be obtained and there are disadvantages such as background fog. Conventionally, it has been attempted to improve initial rise of triboelectric charges by using a charge control agent or the like. However, since dispersibility of the charge control agent in a toner is insufficient, initial rise has not been sufficiently exhibited. Therefore, it has been attempted that a specified clay-organic complex is used as a charge control agent, whereby dispersibility of the charge control agent is increased to improve the initial rise (see Patent Publications 1 and 2).

However, with the advancement of higher image qualities and higher speed of machine in the recent years, in order to provide a toner with a high added value, various toners containing a large amount of wax and a crystalline polyester have been developed, and development of a toner having not only initial rise of triboelectric charges but also high saturation triboelectric charges has been desired.

Patent Publication 1: JP-A-2004-117651

Patent Publication 2: JP-A-Hei 8-6295

SUMMARY OF INVENTION

The present invention relates to a toner for electrophotography containing a resin binder, a colorant, and a clay-organic complex obtained by intercalating into a smectite clay a quaternary ammonium salt represented by the formula (A):

$$[(R^1)_3(R^2)N]^+.X^- \quad (A)$$

wherein $R^1$ and $R^2$ are not identical; $R^1$ is an alkyl group, alkenyl group, or alkynyl group, each having 4 to 24 carbon atoms; $R^2$ is an alkyl group, alkenyl group, or alkynyl group, each having 1 to 10 carbon atoms; and $X^-$ is an anion.

DETAILED DESCRIPTION OF THE INVENTION

The present invention relates to a toner for electrophotography, which has high saturation triboelectric charges and is excellent in image properties.

The toner for electrophotography of the present invention has high saturation triboelectric charges and exhibits excellent effects on image properties.

The toner for electrophotography of the present invention contains a resin binder, a colorant, and a clay-organic complex.

As the resin binder, it is preferable that a polyester is contained, and it is more preferable that a crystalline polyester and an amorphous polyesters are used together. The crystallinity of the polyester is expressed as an index of crystallinity as defined by a ratio of a softening point to a highest temperature of endothermic peak determined by a differential scanning calorimeter, i.e., (softening point)/(highest temperature of endothermic peak). Generally, when the above-mentioned value exceeds 1.5, the resin is amorphous; and when the value is less than 0.6, the resin is low in crystallinity and mostly amorphous. The crystallinity of the resin can be adjusted by the kinds of the raw material monomers and a ratio thereof, preparation conditions (for example, reaction temperature, reaction time, and cooling rate), and the like. For example, an aliphatic alcohol and an aliphatic carboxylic acid compound which have a similar short molecular chain and are relatively likely to be regularly arranged are combined as the raw material monomers, whereby crystallization of the polyester can be promoted. In addition, the highest temperature of endothermic peak tends to be higher as the resin has higher crystallinity, and can be adjusted by, for example, a ratio of monomers promoting crystallization and monomers promoting amorphousness. The highest temperature of endothermic peak refers to a peak temperature on the highest temperature side among the endothermic peaks observed. When a difference between the highest peak temperature and the softening point is within 20° C., the peak temperature is defined as a melting point. When the difference between the highest peak temperature and the softening point exceeds 20° C., the peak temperature is ascribed to a glass transition.

The crystalline polyester in the present invention refers to those having an index of crystallinity of from 0.6 to 1.5. The crystalline polyesters has an index of crystallinity of preferably from 0.8 to 1.3, more preferably from 0.9 to 1.1, and even more preferably from 0.95 to 1.05, from the viewpoint of low-temperature fixing ability. In addition, the amorphous polyester in the present invention refers to those having an index of crystallinity of more than 1.5 or less than 0.6, and preferably more than 1.5.

The crystalline polyester and the amorphous polyester are both obtained from an alcohol component and a carboxylic acid component as the raw material monomers.

The alcohol component includes aliphatic diols such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,4-butenediol, 1,2-propanediol, 1,3-butanediol, neopentyl glycol, and 2-butyl-2-ethyl-1,3-propanediol; aromatic diols such as an alkylene oxide adduct of bisphenol A, represented by the formula (I):

[Ka 1]

(I)

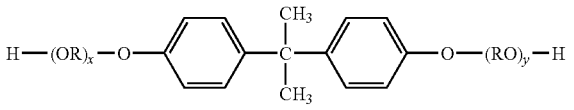

wherein R is an alkylene group having 2 or 3 carbon atoms, x and y are positive numbers, wherein a sum of x and y is from 1 to 16, and preferably from 1.5 to 5.0, such as polyoxypropylene(2.2)-2,2-bis(4-hydroxyphenyl) propane and polyoxyethylene(2.2)-2,2-bis(4-hydroxyphenyl)propane; trihydric or higher polyhydric alcohols such as glycerol and pentaerythritol; and the like.

Among these alcohol components, the alcohol component which promotes crystallization of the polyester includes an aliphatic diol having 2 to 6 carbon atoms, such as ethylene glycol, 1,3-propanediol, 1,4-butanediol, 1,5-pentanediol, 1,6-hexanediol, and 1,4-butenediol; and the like.

The carboxylic acid component includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acid; aromatic dicarboxylic acids such as phthalic acid, isophthalic acid, and terephthalic acid; tricarboxylic or higher polycarboxylic acids such as trimellitic acid and pyromellitic acid; acid anhydrides thereof, alkyl (1 to 3 carbon atoms) esters thereof; and the like. The above-mentioned acids, acid anhydrides thereof and alkyl esters of the acids are collectively referred to herein as carboxylic acid compound.

Among these carboxylic acid components, the carboxylic acid component which promotes crystallization of the polyester includes an aliphatic dicarboxylic acid compound having 2 to 6 carbon atoms, such as oxalic acid, malonic acid, maleic acid, fumaric acid, succinic acid, and adipic acid; and the like.

Further, the raw material monomers may properly contain a monohydric alcohol and a monocarboxylic acid compound, within the range which would not impair the effects of the present invention, from the viewpoint of adjusting the molecular weight or the like.

The polyester can be obtained by polycondensing the alcohol component and the carboxylic acid component, for example, in an inert gas atmosphere, in the presence of an esterification catalyst as desired. The reaction temperature is preferably from 120° to 230° C. in the preparation of the crystalline polyester, and is preferably from 150° to 280° C. and more preferably from 200° to 250° C. in the preparation of the amorphous polyester.

As the alcohol component which is the raw material monomer of the crystalline polyester, an aliphatic diol having 2 to 6 carbon atoms is preferable. Among them, α,ω-linear alkanediols are preferable, and 1,6-hexanediol is more preferable. Also, as the carboxylic acid component, fumaric acid is preferable from the viewpoint of promoting the crystallization of the polyester.

Therefore, it is preferable that the crystalline polyester is a resin obtained by polycondensing the alcohol component containing an aliphatic diol having 2 to 6 carbon atoms in an amount of from 60% by mole or more, and preferably from 70% by mole or more, with the carboxylic acid component containing fumaric acid in an amount of from 60% by mole or more, and preferably from 70% by mole or more.

The crystalline polyester has a melting point of preferably from 70° to 150° C., and more preferably from 90° to 130° C.

The amorphous polyester has a softening point of preferably from 80° to 160° C., and more preferably from 90° to 150° C. In addition, the amorphous polyester has a glass transition temperature of preferably from 50° to 75° C., and more preferably from 53° to 65° C.

The crystalline polyester and the amorphous polyester have an acid value of preferably from 3 to 40 mgKOH/g.

A weight ratio of the amorphous polyester to the crystalline polyester (a weight ratio of amorphous polyester/crystalline polyester) is preferably from 60/40 to 99/1, and more preferably 70/30 to 95/5.

The amorphous polyester and the crystalline polyester are contained in the resin binder in a total amount of preferably 50% by weight or more, more preferably 70% by weight or more, and even more preferably 90% by weight or more. The resin binder other than the crystalline polyester and the amorphous polyester includes vinyl resins such as styrene-acrylic resins; epoxy resins; polycarbonates; polyurethanes; and the like. The resin binder is contained in a total amount of preferably from 50 to 99% by weight, more preferably from 60 to 97% by weight, and even more preferably from 70 to 95% by weight, of the toner, from the viewpoint of triboelectric chargeability and fixing ability.

The colorant is not particularly limited, and includes known colorants, which can be properly selected according to its purposes. Specifically, the colorant includes various pigments such as carbon blacks, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green, and Malachite Green Oxalate; and various dyes such as Acridine dyes, Xanthene dyes, azo dyes, benzoquinone dyes, Azine dyes, anthraquinone dyes, indigo dyes, thioindigo dyes, Phthalocyanine dyes, Aniline Black dyes, polymethine dyes, triphenylmethane dyes, diphenylmethane dyes, thiazine dyes, and thiazole dyes, and these pigments and dyes can be used alone or in admixture of two or more kinds. The colorant is contained in an amount of preferably from 1 to 15% by weight, more preferably from 2 to 10% by weight, and more preferably from 3 to 8% by weight, of the toner.

One of the significant features of the toner of the present invention resides in that the toner contains a clay-organic complex obtained by intercalating a specified quaternary ammonium salt into a smectite clay. The clay-organic complex has a high performance as an agent for increasing saturation triboelectric charges, especially as an agent for increasing negatively chargeable saturation triboelectric charges. At the same time, the clay-organic complex can be homogeneously dispersed in the toner without specially adjusting preparation conditions of the toner and an additive.

The smectite clay includes natural smectite clays such as hectorite, saponite, stevensite, beidellite, montmorillonite, nontronite, and bentonite; synthetic smectite clays which are chemically synthesized; substitution products and derivatives thereof; and mixtures thereof; and the like.

The smectite clay has a cationic exchange capacity of preferably 70 milliequivalents or more, and more preferably from 85 to 130 milliequivalents per 100 g of the clay.

Non-clay impurities are contained in the smectite clay used in the present invention in an amount of preferably 10% by weight or less.

The quaternary ammonium salt is represented by the formula (A):

$$[(R^1)_3(R^2)N]^+.X^- \quad (A).$$

In the formula, $R^1$ and $R^2$ are not identical, and each of $R^1$ and $R^2$ is an alkyl group, alkenyl group, or alkynyl group, preferably an alkyl group or alkenyl group, and more preferably an alkyl group.

Three of $R^1$ may be identical or different from each other, and an alkyl group, alkenyl group, or alkynyl group represented by $R^1$ has 4 to 24 carbon atoms, preferably 6 to 20, and more preferably 8 to 18 carbon atoms.

An alkyl group, alkenyl group, or alkynyl group represented by $R^2$ have 1 to 10 carbon atoms, preferably 1 to 8, more preferably 1 to 6, and even more preferably 1 to 2 carbon atoms.

Specific examples of an ammonium ion in the formula include trioctyl methyl ammonium ion, tristearyl ethyl ammonium ion, trioctyl ethyl ammonium ion, tristearyl methyl ammonium ion, tridecyl hexyl ammonium ion, tritetradecyl propyl ammonium ion, and the like. Among them, trioctyl methyl ammonium ion and tristearyl ethyl ammonium ion are preferable.

In the formula, $X^-$ is an anion. As the anion, X includes, for example, $Cl^-$, $Br^-$, $OH^-$, $NO_3^-$, and the like.

A method of obtaining a clay-organic complex by intercalating a quaternary ammonium salt into a smectite clay includes, for example, a method including the step of replacing an exchangeable cation of a smectite clay by trioctyl methyl ammonium ion via an ion-exchange process.

More specific method includes, for example, a method including the steps of adding a quaternary ammonium salt to a suspension of a smectite clay in which the smectite clay is dispersed in water, and reacting the mixture. The concentration of a solid (smectite clay) dispersed in the suspension is not particularly limited as long as the concentration is in the range that the smectite clay is dispersible, and is preferably from 1 to 5% by weight or so. In this step, a smectite clay which has been previously lyophilized may be used.

It is preferable that the amount of the quaternary ammonium salt formulated is adjusted so that the cationic exchange capacity of the smectite clay and the quaternary ammonium ion are equivalent. The clay-organic complex can be prepared with the quaternary ammonium salt in an amount less than the amount mentioned above. In addition, the quaternary ammonium salt may be added in an excess amount relative to the cationic exchange capacity. Concretely, the quaternary ammonium ion is contained in an amount preferably from 0.5 to 1.5 times (calculated as milliequivalent), and more preferably from 0.8 to 1.2 times, as the cationic exchange capacity of the smectite clay.

The temperature for reaction of the smectite clay and the quaternary ammonium salt is preferably a decomposition point of the quaternary ammonium salt or lower.

After reaction, the reaction mixture is subjected to solid-liquid separation, and the produced organic clay complex is washed with water or hot water to remove a by-product electrolyte. Thereafter, the washed organic clay complex is dried, and pulverized as occasion demands, and whereby a clay-organic complex is obtained.

The production of the clay-organic complex can be confirmed by selecting a method utilizing a chemical analysis, X-ray diffraction, NMR, an infrared absorption spectrum, a thermobalance, a differential thermal analysis, a high polar solvent-based rheology, swelling power in a high polar organic solvent, hue, or the like according to its purposes, and appropriately combining them.

For example, in a method utilizing X-ray diffraction, the production of the clay-organic complex can be easily confirmed by determining a level of 001 basal reflection. The raw material smectite clay has a basal spacing of 10 Å in a dehydrated state, and a basal spacing of from 12 to 16 Å at ordinary temperature and humidity. The clay-organic complex in the present invention has a basal spacing of 18 Å or so.

The clay-organic complex is contained in an amount of preferably from 0.1 to 8% by weight, more preferably from 0.4 to 4% by weight, and even more preferably from 0.9 to 3% by weight, of the toner.

Further, the toner of the present invention may properly contain a known charge control agent within the range which would not impair the effects of the present invention, in addition to the clay-organic complex as the improver of saturation triboelectric charges. Among others, it is preferable that an iron complex is used together from the viewpoint of dispersibility in the polyester, and that a metal complex of an aromatic hydroxycarboxylic acid is used together from the viewpoint of initial rise of triboelectric charge.

The iron complex is preferably an azo iron complex or the like, and more preferably a compound represented by the formula (II):

(II)

[Ka2]

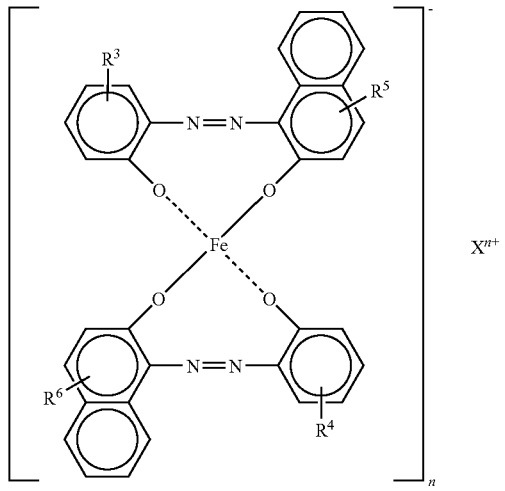

wherein each of $R^3$ and $R^4$ is independently a halogen atom or a nitro group; each of $R^5$ and $R^6$ is independently a hydrogen atom, a halogen atom, an alkyl group having 1 to 3 carbon atoms or —CO—NH— ($C_6H_5$) group; $X^{n+}$ is a cation; and n is an integer of 1 or 2.

In the formula, a cation represented by $X^{n+}$ includes a monovalent cation such as an alkali metal ion such as $H^+$, $Na^+$, $K^+$, or $Li^+$, or $NH_4^+$; and a divalent cation such as $Ca^{2+}$, $Mg^{2+}$, or $Zn^{2+}$. Among them, a monovalent cation is preferable, and $NH_4^+$, $H^+$, and $Na^+$ are more preferable.

As $R^3$ and $R^4$, a halogen atom is preferable, and chlorine atom is more preferable.

As $R^5$ and $R^6$, —CO—NH—($C_6H_5$) group is preferable.

Incidentally, a compound represented by the formula (II), of which preparation method is described in detail in JP-A-Sho 61-155464 and the like, can be easily synthesized according to the preparation method. The commercially available product includes, for example, "T-77" (manufactured by Hodogaya Chemical Co., Ltd) containing the compound represented by the formula (IIa):

(IIa)

[Ka3]

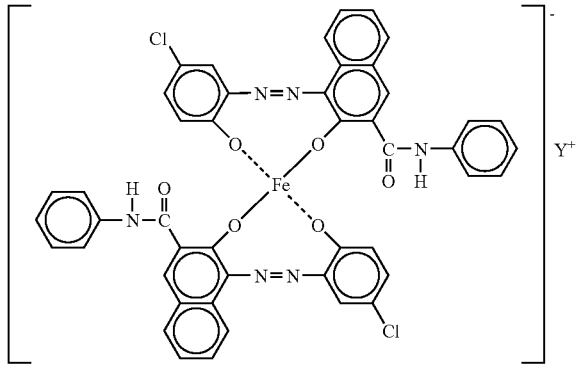

wherein $Y^+$ is $NH_4^+$, $H^+$ or $Na^+$.

The iron complex is contained in an amount of preferably from 0.1 to 8% by weight, more preferably from 0.4 to 4% by weight, and even more preferably from 0.9 to 2% by weight, of the toner.

The metal complex of an aromatic hydroxycarboxylic acid is preferably a compound represented by the formula (III):

[Ka 4]

(III)

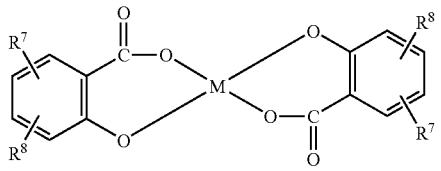

wherein each of $R^7$ and $R^8$ is an alkyl group having 1 to 8 carbon atoms, and preferably tert-butyl group; and M is chromium, iron or zinc.

A commercially available product of the metal complex of an aromatic hydroxycarboxylic acid includes "BONTRON E-81," "BONTRON E-84" (manufactured by Orient Chemical Co., Ltd.), and the like.

The metal complex of an aromatic hydroxycarboxylic acid is contained in an amount of preferably from 0.1 to 8% by weight, more preferably from 0.4 to 4% by weight, and even more preferably from 0.9 to 2% by weight, of the toner.

Further, the toner of the present invention may properly contain an additive such as a releasing agent, an electric conductivity modifier, an extender, a reinforcing filler such as a fibrous substance, an antioxidant, an anti-aging agent, or a magnetic material.

The toner of the present invention can be prepared according to a known method such as a kneading-pulverization method, an emulsion aggregation method, a spray-drying method, or a polymerization method. A general method for preparing a pulverized toner according to the kneading-pulverization method includes, for example, a method including the steps of homogeneously mixing a resin binder, a colorant, a charge control agent, and the like in a mixer such as a ball-mill, thereafter melt-kneading with a closed kneader, a single-screw or twin-screw extruder or the like, cooling, pulverizing and classifying the product. Further, a fluidity improver such as a hydrophobic silica, or the like may be optionally added to a roughly pulverized product during the preparation process, or to a surface of the resulting toner. The toner of the present invention has a volume-median particle size ($D_{50}$) of preferably from 3 to 15 μm, and more preferably from 4 to 8 μm. The term "volume-median particle size ($D_{50}$)" as used herein refers to a particle size of which cumulative volume frequency calculated on a volume percentage is 50% counted from the smaller particle sizes.

The toner for electrophotography of the present invention can be either directly used as a monocomponent toner for development in a monocomponent developing method, or used as a two-component developer in which the toner mixed with a carrier in a two-component developing method.

EXAMPLE

The following examples further describe and demonstrate embodiments of the present invention. The examples are given solely for the purposes of illustration and are not to be construed as limitations of the present invention.

[Softening Point of Resin]

The softening point refers to a temperature at which a half the amount of the sample flows out when plotting a downward movement of a plunger against temperature, as measured by using a flow tester (CAPILLARY RHEOMETER "CFT-500D," manufactured by Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Highest Temperature of Endothermic Peak and Melting Point of Resin]

The highest temperature of endothermic peak is determined using a differential scanning calorimeter ("DSC210," manufactured by Seiko Instruments, Inc.), by raising its temperature to 200° C., cooling the hot sample from this temperature to 0° C. at a cooling rate of 10° C./min, and thereafter heating the sample so as to raise the temperature at a rate of 10° C./min. Among the endothermic peaks observed, the temperature of an endothermic peak on the highest temperature side is defined as a highest temperature of endothermic peak. When a difference between the highest peak temperature and the softening point is within 20° C., the highest peak temperature is defined as a melting point.

[Glass Transition Temperature of Resin]

The glass transition temperature is determined using a differential scanning calorimeter ("DSC210," manufactured by Seiko Instruments, Inc.), by raising its temperature to 200° C., cooling the sample from this temperature to 0° C. at a cooling rate of 10° C./min, and thereafter raising the temperature of the sample at a rate of 10° C./min.

When a difference between the highest temperature of endothermic peak and the softening point is within 20° C., a temperature of an intersection of the extension of the baseline of equal to or lower than the temperature of a peak observed at a temperature lower than the highest temperature of endothermic peak and the tangential line showing the maximum inclination between the kick-off of the peak and the top of the peak is read as a glass transition temperature.

When a difference between the highest temperature of endothermic peak and the softening point exceeds 20° C., a temperature of an intersection of the extension of the baseline of equal to or lower than the highest temperature of endothermic peak and the tangential line showing the maximum inclination between the kick-off of the peak and the top of the peak is read as a glass transition temperature.

[Index of Crystallinity of Resin]

The index of crystallinity is calculated from the softening point and the highest temperature of endothermic peak determined in accordance with the methods mentioned above using the following formula:

$$\text{Index of Crystallinity of Resin} = \text{Softening Point} / \text{Highest Temperature of Endothermic Peak}$$

[Acid Value of Resin]

The acid value is determined by a method according to JIS K0070.

[Volume-Median Particle Size ($D_{50}$) of Toner]

Measuring Apparatus: Coulter Multisizer II (manufactured by from Beckman Coulter K.K.)

Aperture Diameter: 100 μm

Range of Particle Sizes to Be Determined: 2 to 60 μm

Analyzing Software: Coulter Multisizer AccuComp Ver. 1.19 (manufactured by Beckman Coulter K.K.)

Electrolytic solution: "Isotone II" (manufactured by Beckman Coulter K.K.)

Dispersion: A 5% electrolytic solution of "EMULGEN 109P" (manufactured by Kao Corporation, polyoxyethylene lauryl ether, HLB: 13.6)

Dispersion Conditions: Ten milligrams of a test sample is added to 5 ml of the dispersion, and the resulting mixture is dispersed in an ultrasonic disperser for 1 minute. Thereafter, 25 ml of the electrolytic solution is added to the dispersion, and the resulting mixture is dispersed in the ultrasonic disperser for another 1 minute.

Measurement Conditions: One-hundred milliliters of the electrolytic solution and the dispersion are added to a beaker, and the particle sizes of 30,000 particles are determined under the conditions for concentration satisfying that the determination for 30,000 particles are completed in 20 seconds. The volume-median particle size ($D_{50}$) is obtained from the particle size distribution.

Production Example 1 for Resin

A 5-liter four-necked flask equipped with a nitrogen inlet tube, a dehydration tube, a stirrer, and a thermocouple was charged with the raw material monomers shown in Table 1 other than trimellitic anhydride, and 4 g of dibutyltin oxide. The ingredients in the flask were reacted at 230° C. over a period of 20 hours, and thereafter reacted at 8.3 kPa for 1 hour. Further, trimellitic anhydride shown in Table 1 was added thereto at 210° C., and the mixture was reacted until a desired softening point was reached, to give a resin A.

Production Example 2 for Resin

A 5-liter four-necked flask equipped with a nitrogen inlet tube, a dehydration tube, a stirrer, and a thermocouple was charged with the raw material monomers shown in Table 1 other than trimellitic anhydride, 4 g of dibutyltin oxide, and 1 g of hydroquinone. The ingredients in the flask were reacted at 200° C. over a period of 8 hours, and thereafter reacted at 8.3 kPa for 1 hour. Further, trimellitic acid shown in Table 1 was added thereto at 210° C., and the mixture was reacted until a desired softening point was reached, to give resins B and C.

Production Example 3 for Resin

A 5-liter four-necked flask equipped with a nitrogen inlet tube, a dehydration tube, a stirrer, and a thermocouple was charged with the raw material monomers shown in Table 1, 4 g of dibutyltin oxide, and 1 g of hydroquinone. The ingredients in the flask were reacted at 160° C. over a period of 5 hours, and thereafter raised its temperature to 200° C. and reacted for 1 hour. Further, the mixture was reacted at 8.3 kPa until a desired molecular weight was reached, to give a resin a.

TABLE 1

| | Amorphous Polyester | | | Crystalline Polyester |
|---|---|---|---|---|
| | Resin A | Resin B | Resin C | Resin a |
| Raw Material Monomers | | | | |
| BPA-PO [1)] | 2800 g (80) | 1400 g (80) | 873 g (50) | — |
| BPA-EO [2)] | 650 g (20) | 325 g (20) | 813 g (50) | — |
| 1,6-Hexanediol | — | — | — | 2360 g (100) |
| Terephthalic Acid | 996 g (60) | — | — | — |
| Alkenyl Succinic Anhydride | 268 g (10) | — | — | — |
| Fumaric acid | — | 551 g (95) | 435 g (75) | 2320 g (100) |
| Stearic Acid | — | — | — | 228 g (4) |
| Trimellitic Anhydride | 384 g (20) | — | 240 g (25) | — |
| Resin Properties | | | | |
| Acid Value (mgKOH/g) | 21.3 | 28.7 | 29.6 | 22.5 |
| Softening Point (° C.) | 145.6 | 101.3 | 144.8 | 107.3 |
| Glass Transition Temp. (° C.) | 62.7 | 61.1 | 59.1 | — |
| Highest Temperature of Endothermic Peak (° C.) | 65.6 | 63.2 | 63.0 | 110.1 |
| Index of Crystallinity | 2.2 | 1.6 | 2.3 | 0.97 |

[1)] Polyoxypropylene(2.2)-2,2-bis(4-hydroxyphenyl)propane

[2)] Polyoxyethylene(2.2)-2,2-bis(4-hydroxyphenyl)propane

Production Example 1 for Clay-Organic Complex

The amount 20 g of a synthetic smectite having a composition of hectorite, a basal spacing of 12.5 Å in the air, and a cationic exchange capacity of 110 milliequivalents/100 g was dispersed in 1000 ml of tap water. Thereto was added 300 ml of a solution obtained by dissolving a product containing 80% of trioctyl methyl ammonium chloride in pure water, and the mixture was reacted for 2 hours at room temperature while stirring. Subsequently, the resulting product was subjected to solid-liquid separation, washed to remove by-product salts, and thereafter dried and pulverized, to give a clay-organic complex A.

The resulting clay-organic complex, as determined by X-ray diffraction, had a basal spacing of 18.0 Å calculated from 001 basal reflection thereof.

Production Example 2 for Clay-Organic Complex

The same procedures as the clay-organic complex A were carried out except that 13.5 g of tristearyl ethyl ammonium chloride was used in place of trioctyl methyl ammonium chloride, to give a clay-organic complex B.

Production Example 3 for Clay-Organic Complex

The same procedures as the clay-organic complex A were carried out except that 12.4 g of dimethyl dioctadecyl ammonium chloride was used in place of trioctyl methyl ammonium chloride, to give a clay-organic complex C.

Production Example 4 for Clay-Organic Complex

The same procedures as the clay-organic complex A were carried out except that 11.5 g of dimethyl ditetradecyl ammonium chloride was used in place of trioctyl methyl ammonium chloride, to give a clay-organic complex D.

Production Example 5 for Clay-Organic Complex

The same procedures as the clay-organic complex A were carried out except that 20 g of a synthetic smectite having a composition of montmorillonite was used in place of the synthetic smectite having a composition of hectorite, to give a clay-organic complex E.

Examples 1 to 8 and Comparative Examples 1 to 3

A resin binder, a clay-organic complex, a charge control agent, a colorant or a magnetic powder, and a wax as shown in Table 2 were supplied into a 5-liter Henschel mixer, and mixed for 5 minutes at a rotational speed of 3600 r/min.

The resulting mixture was melt-kneaded using a co-rotating twin-screw extruder (entire length of the kneading portion: 1560 mm, screw diameter: 42 mm, a barrel inner diameter of 43 mm) at a rotational speed of 200 r/min, and thereafter cooled. The set temperature within the roller was 100° C., the temperature at outlet for the kneaded product was about 150° C., the feeding rate of the mixture was 10 kg/h, and the average residence time was about 18 seconds.

The cooled product was roughly pulverized, finely pulverized with a jet mill, and further classified, to give a powder having a volume-median particle size ($D_{50}$) of 8.0 μm.

An external additive was added to 100 parts by weight of the resulting powder, and the mixture was mixed with a Henschel mixer, to give a toner. In Examples 1 to 6, and 8, and Comparative Examples 1 to 3, 0.2 parts by weight of a hydrophobic silica "TS720" (manufactured by Cabot Corporation) was used as an external additive. In Example 7, 2.0 parts by weight of a hydrophobic silica "AEROSIL R972" (manufactured by Nippon Aerosil) and 1.0 part by weight of strontium titanate "TiSr" (manufactured by Fuji Titanium Industry Co., Ltd.) were used as external additives.

Incidentally, a part of a toner was collected before adding the external additive thereto. The amounts of 4 parts by weight of the above-mentioned toner and 96 parts by weight of a silicone-coated ferrite carrier (manufactured by Kanto Denka Kogyo Co., Ltd., average particle size: 90 μm) were mixed with a ball-mill for 1 minute. Thereafter, the saturation triboelectric charges of the toner were determined using a "q/m Meter MODEL 210HS" (manufactured by TREK). The results are shown in Table 2.

Test Example 1

Two-Component Developing Method

Each of the toners obtained in Examples 1 to 6, and 8 and Comparative Examples 1 to 3 and 96 parts by weight of a silicone-coated ferrite carrier (manufactured by Kanto Denka Kogyo Co., Ltd., average particle size: 90 μm) were mixed, to give a two-component developer.

A toner was loaded in a copy machine "AR-505" (manufactured by Sharp Corporation), and an unfixed image (2 cm×12 cm) with an amount of toner adhesion of 0.6 mg/cm$^2$ was obtained. The unfixed image was fixed using a fixing device in a copy machine "AR-505" (manufactured by Sharp Corporation) in the conditions such that offset was not generated outside the apparatus.

The optical reflective density of the resulting image was measured with a reflective densitometer "RD-915" (manufactured by Macbeth Process Measurements Co.). The image density (the optical reflective density) was evaluated in accordance with the following evaluation criteria. The results are shown in Table 2.

[Evaluation Criteria]

◎: Image density being 1.4 or more;

○: Image density being 1.2 or more and less than 1.4; and x: Image density being less than 1.2.

Test Example 2

Magnetic Monocomponent Developing Method

A toner obtained in Example 7 was loaded in a "LaserJet 4200" (manufactured by Hewlett Packard), and an unfixed image (2 cm×12 cm) with an amount of toner adhesion of 0.6 mg/cm$^2$ was obtained. The unfixed image was fixed using a fixing device in a copy machine "AR-505" (manufactured by Sharp Corporation) in the conditions such that offset was not generated outside the apparatus.

The image density of the resulting image was evaluated in the same manner as in Test Example 1. The results are shown in Table 2.

TABLE 2

| | Resin Binder | Clay-Organic Complex | Charge Control Agent 1) | Colorant or Magnetic Powder 2) | Wax 3) | Saturation Tribo-electric Charges(μC/g) | Image Density |
|---|---|---|---|---|---|---|---|
| Ex. 1 | Resin C = 50<br>Resin B = 30<br>Resin a = 20 | A = 1 | T-77 = 1 | Carbon Black = 4 | PP Wax A = 2<br>Carnauba = 2 | −25.8 | ◎ |
| Ex. 2 | Resin C = 50<br>Resin B = 50 | A = 1 | T-77 = 1 | Carbon Black = 4 | PP Wax A = 2<br>Carnauba = 2 | −24.2 | ○ |
| Ex. 3 | Resin A = 45<br>Resin B = 30<br>Resin a = 25 | A = 1 | T-77 = 1 | Carbon Black = 4 | PP Wax A = 2<br>Carnauba = 2 | −21.6 | ○ |
| Ex. 4 | Resin C = 30<br>Resin B = 50<br>Resin a = 20 | A = 1 | E-84 = 1.5 | Cyan Pigment = 4 | Carnauba = 5 | −20.5 | ○ |
| Ex. 5 | Resin C = 50<br>Resin B = 30<br>Resin a = 20 | B = 3 | T-77 = 1 | Carbon Black = 4 | PP Wax A = 2<br>Carnauba = 2 | −19.5 | ○ |
| Ex. 6 | Resin C = 50<br>Resin B = 30<br>Resin a = 20 | A = 0.5 | T-77 = 1 | Carbon Black = 4 | PP Wax A = 2<br>Carnauba = 2 | −18.7 | ○ |
| Ex. 7 | Resin C = 50<br>Resin B = 30<br>Resin a = 20 | A = 1 | T-77 = 0.5 | Magnetic Powder = 70 | PP Wax B = 0.5 | −18.9 | ◎ |
| Ex. 8 | Resin C = 50<br>Resin B = 30<br>Resin a = 20 | E = 1 | T-77 = 1 | Carbon Black = 4 | PP Wax A = 2<br>Carnauba = 2 | −20.3 | ○ |
| Comp. Ex. 1 | Resin C = 50<br>Resin B = 30<br>Resin a = 20 | C = 3 | T-77 = 1 | Carbon Black = 4 | PP Wax A = 2<br>Carnauba = 2 | −10.3 | X |
| Comp. Ex. 2 | Resin C = 50<br>Resin B = 30<br>Resin a = 20 | D = 3 | T-77 = 1 | Carbon Black = 4 | PP Wax A = 2<br>Carnauba = 2 | −11.5 | X |
| Comp. Ex. 3 | Resin C = 50<br>Resin B = 30<br>Resin a = 20 | — | T-77 = 1 | Carbon Black = 4 | PP Wax A = 2<br>Carnauba = 2 | −4.1 | X |

Note)

The amount is expressed by parts by weight.

1) T-77: manufactured by Hodogaya Chemical Co., Ltd E-84 (BONTRON E-84): manufactured by Orient Chemical Co., Ltd.

2) Carbon Black: MONARCH 880 (manufactured by Cabot Corporation) Cyan Pigment: ECB-301 (manufactured by DAINICHISEIKA COLOR & CHEMICALS MFG. CO., LTD.) Magnetic Powder: MTS106HD (manufactured by Toda Kogyo Corp)

3) PP Wax (polypropylene wax) A: NP-055 (manufactured by MITSUI CHEMICALS, INC.) PP Wax (polypropylene wax) B: SP-105 (manufactured by Sazole) Carnauba (Carnauba Wax): Carnauba Wax C1 (manufactured by Kato Yoko)

It can be seen from the above results that any of the toners of Examples 1 to 8 has high saturation triboelectric charges and obtains high image density, as compared to the toners of Comparative Examples 1 to 3. Particularly, from the results of Comparative Examples 1 and 2, it is clear that, even a toner contains a clay-organic complex, the performance like the toners of Examples cannot be obtained unless a quaternary ammonium salt having the desired structure is used in the clay-organic complex.

The toner for electrophotography of the present invention is suitably used for, for example, developing a latent image formed in electrophotography, electrostatic recording method, electrostatic printing method, or the like.

The invention claimed is:

1. A toner for electrophotography comprising a resin binder, a colorant, and a clay-organic complex obtained by intercalating into a smectite clay a quaternary ammonium salt represented by the formula (A):

$$[(R^1)_3(R^2)N]^+.X^- \quad (A)$$

wherein $R^1$ and $R^2$ are not identical; $R^1$ is an alkyl group, alkenyl group, or alkynyl group, each having 4 to 24 carbon atoms; $R^2$ is an alkyl group, alkenyl group, or alkynyl group, each having 1 to 10 carbon atoms; and $X^-$ is an anion, wherein the resin binder comprises a crystalline polyester and an amorphous polyester, and wherein the crystalline polyester resin is a resin obtained by polycondensing an alcohol component comprising an aliphatic diol having 2 to 6 carbon atoms with a carboxylic acid component comprising fumaric acid.

2. The toner according to claim 1, wherein the clay-organic complex is present in an amount of from 0.1 to 8% by weight in the toner.

3. The toner according to claim 2, further comprising a charge control agent in an amount of from 0.1 to 8% by weight in the toner.

4. The toner according to claim 1, further comprising a charge control agent in an amount of from 0.1 to 8% by weight in the toner.

5. The toner according to claim 4, wherein the charge control agent comprises a compound represented by the formula (II):

[Ka 1]

(II)

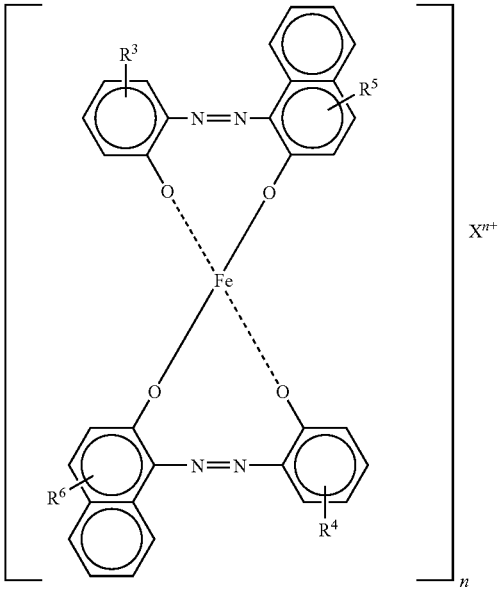

wherein each of $R^3$ and $R^4$ is independently a halogen atom or a nitro group; each of $R^5$ and $R^6$ is independently a hydrogen atom, a halogen atom, an alkyl group having 1 to 3 carbon atoms or —CO—NH—($C_6H_5$) group; $X^{n+}$ is a cation; and n is an integer of 1 or 2.

6. The toner according to claim 1, wherein the alcohol component comprises the aliphatic diol having 2 to 6 carbon atoms in an amount of 60% by mole or more, and the carboxylic acid component comprises the fumaric acid in an amount of 60% by mole or more.

7. The toner according to claim 6, wherein a weight ratio of the amorphous polyester to the crystalline polyester (a weight ratio of amorphous polyester/crystalline polyester) is from 60/40 to 99/1.

8. The toner according to claim 1, wherein a weight ratio of the amorphous polyester to the crystalline polyester is from 70/30 to 95/5.

9. The toner according to claim 1, wherein the crystalline polyester has an index of crystallinity of from 0.6 to 1.5.

10. The toner according to claim 1, wherein the amorphous polyester has an index of crystallinity of more than 1.5 or less than 0.6.

11. The toner according to claim 1, wherein a weight ratio of the amorphous polyester to the crystalline polyester (a weight ratio of amorphous polyester/crystalline polyester) is from 60/40 to 99/1.

12. The toner according to claim 1, wherein $R^1$ has 6 to 20 carbon atoms.

13. The toner according to claim 1, wherein $R^1$ has 8 to 18 carbon atoms.

14. The toner according to claim 1, wherein $R^2$ has 1 to 8 carbon atoms.

15. The toner according to claim 1, wherein $R^2$ has 1 to 6 carbon atoms.

16. The toner according to claim 1, wherein $R^2$ has 1 to 2 carbon atoms.

17. The toner according to claim 1, wherein the quaternary ammonium salt comprises a trioctyl methyl ammonium ion or a tristearyl ethyl ammonium ion.

18. The toner according to claim 1, wherein the clay-organic complex is present in an amount of from 0.9 to 3% by weight of the toner.

* * * * *